US010642184B2

(12) United States Patent
Matsuo et al.

(10) Patent No.: US 10,642,184 B2
(45) Date of Patent: May 5, 2020

(54) OPTICAL WRITING DEVICE AND IMAGE FORMING APPARATUS

(71) Applicant: Konica Minolta, Inc., Tokyo (JP)

(72) Inventors: Takahiro Matsuo, Toyokawa (JP); Atsushi Nagaoka, Okazaki (JP); Masahiko Takahashi, Hino (JP)

(73) Assignee: Konica Minolta, Inc., Tokyo (JP)

( * ) Notice: Subject to any disclaimer, the term of this patent is extended or adjusted under 35 U.S.C. 154(b) by 44 days.

(21) Appl. No.: 16/180,647

(22) Filed: Nov. 5, 2018

(65) Prior Publication Data

US 2019/0146372 A1 May 16, 2019

(30) Foreign Application Priority Data

Nov. 15, 2017 (JP) ..... 2017-219640

(51) Int. Cl.
*G03G 15/04* (2006.01)
*B41J 2/45* (2006.01)

(52) U.S. Cl.
CPC ..... *G03G 15/04054* (2013.01); *B41J 2/45* (2013.01); *G03G 2215/0409* (2013.01)

(58) Field of Classification Search
CPC . B41J 2/385; B41J 2/3855; B41J 2/435; B41J 2/45; B41J 2/47; B41J 2/471
See application file for complete search history.

(56) References Cited

FOREIGN PATENT DOCUMENTS

JP 2011-095460 A 5/2011

*Primary Examiner* — Scott A Richmond
(74) *Attorney, Agent, or Firm* — Osha Liang LLP

(57) ABSTRACT

An optical writing device includes: a light emitting member on which a plurality of light emitting elements are arranged in a row; and a holding member on which a plurality of projections are arranged at intervals. In the optical writing device, a rear surface of the light emitting member opposite to a light emitting surface of the light emitting member contacts tops of the projections, and the light emitting member is fixed to the holding member via adhesives disposed on two opposite sides of each of the projections in a short direction of the holding member on the holding member so as to be separated from the projection.

9 Claims, 12 Drawing Sheets

OPTICAL WRITING DEVICE AND IMAGE FORMING APPARATUS

The entire disclosure of Japanese patent Application No. 2017-219640, filed on Nov. 15, 2017, is incorporated herein by reference in its entirety.

BACKGROUND

Technological Field

The present invention relates to an optical writing device including a light emitting panel having a plurality of light emitting elements arranged thereon and a holder therefor, and an image forming apparatus including the optical writing device.

Description of the Related Art

In an image forming apparatus, a photoreceptor uniformly charged by a charging device is exposed and scanned by an optical scanning device, and an electrostatic latent image is formed on the surface thereof, and the electrostatic latent image is developed using toner by a developing device and visualized as a toner image. The optical scanning device is formed by housing, in a housing: optical members such as a collimator lens, a cylindrical lens, a scanning lens, a reflection mirror, and a polygon mirror; and a polygon motor that rotationally drives the polygon mirror.

When there is an assembling error or the like of the reflection mirror in the housing or the like, a scanning line is curved by deflection of the reflection mirror and degradation of image quality may be caused. To avoid the degradation of image quality, a plurality of protrusions protruding toward the reflection mirror side may be provided at a holding member that holds the reflecting mirror, an appropriate protrusion is selected from the plurality of protrusions in accordance with a shape and an extent of the curve of the scanning line, and deflection of the reflection mirror is corrected by partly bonding the holding member to the reflection mirror with an adhesive at the selected protrusion (JP 2011-95460 A).

Additionally, to ensure assembling accuracy of the optical members, there is a known technique in which optical members are held by three bearing surfaces.

As illustrated in FIGS. 12A and 12B, three bearing surfaces 303*a*, 303*b*, and 303*c* are provided at a holder 304, and a holding region 303 that is a flat surface is defined by the bearing surfaces 303*a*, 303*b*, and 303*c*. An adhesive is thickly applied to an adhesive application region 302 provided in the holding region 303, and an optical member 301 is made to contact the bearing surfaces 303*a*, 303*b*, and 303*c*. Here, when a material having a shrinking property at the time of hardening is used as the adhesive, the optical member 301 is pressed against the bearing surfaces 303*a*, 303*b*, 303*c* by hardening shrinkage force of the adhesive. As a result, the optical member 301 is accurately positioned and stably held by the holding region 303 defined by the bearing surfaces 303*a*, 303*b*, and 303*c*.

In this case, the optical member 301 is not held by using an entire surface of the holder 304 as a bearing surface, but the bearing surfaces to hold the optical member 301 are limited to the three bearing surfaces 303*a*, 303*b*, and 303*c*. Since the bearing surfaces are limited to the bearing surfaces 303*a*, 303*b*, and 303*c*, the area of the bearing surfaces is more reduced than in a case of using the entire surface of the holder 304 as the bearing surface, and processing accuracy of the bearing surfaces can be easily ensured.

Additionally, the adhesive generally has a lower Young's modulus than a material of the optical member 301 and a material of the holder 304 do, and therefore, in a case where an environment temperature is changed, a difference in thermal expansion between the optical member 301 and the holder 304 can be absorbed by distortion of the adhesive.

In recent years, in an optical writing device of an image forming apparatus, study is made on using a light emitting panel having a structure in which a plurality of organic light emitting diodes (OLEDs) is arranged in a main scanning direction.

In a case of using such a light emitting panel in the optical writing device, it is general to use a glass substrate or the like having a low linear expansion coefficient and a low rigidity (small thickness). Therefore, in the case of adopting the structure in which a light emitting panel is held by the three bearing surfaces and bonding and fixing the light emitting panel on an inner side of the three bearing surfaces as described above, there may be a case where the light emitting panel is twisted or curved as described in the following.

For example, as illustrated in FIG. 13A, a light emitting panel 311 is arranged in a manner contacting three bearing surfaces 313, 314, and 315 provided at a holder 312, an adhesive is applied to an adhesive application region 316 provided inside a holding region defined by the bearing surfaces 313, 314, and 315, and the light emitting panel 311 is fixed to the holder 312 when the applied adhesive hardens. At this point, as illustrated in FIG. 13B, among side surfaces 317 and 318 extending in a main scanning direction of the light emitting panel 311, the light emitting panel 311 is twisted by hardening shrinkage of the adhesive in a direction from the side surface 317 located on a side close to the bearing surface 314 contacting the light emitting panel 311 toward the side surface 318 located on a side distant from the bearing surface 314. The light emitting panel 311 is twisted most at a center in the main scanning direction thereof.

Furthermore, as illustrated in FIG. 14A, for example, a light emitting panel 331 is arranged in a manner contacting three bearing surfaces 333, 334, and 335 provided at a holder 332, and adhesive application regions 337 and 338 are provided respectively between the bearing surface 333 and the bearing surface 334 and the bearing surface 334 and the bearing surface 335 inside a holding region defined by the bearing surfaces 333, 334, and 335, and adhesives are applied to the adhesive application regions 337 and 338 When the applied adhesives harden, the light emitting panel 331 is fixed to the holder 332. At this point, as illustrated in FIG. 14B, in a case where the light emitting panel is divided into two parts in the main scanning direction at a position of the bearing surface 334 that contacts the light emitting panel 331, respective sides of the light emitting panel 331 are curved in a direction of the holder 332 by hardening shrinkage of the adhesives applied to the adhesive application regions 337 and 338.

As described above, when the light emitting panel is twisted or curved, an optical distance from the light emitting panel to a photoreceptor is varied by a position in the main scanning direction of the light emitting panel. As a result, degradation of image quality may be caused.

SUMMARY

One or more embodiments of the present invention provide: an optical writing device in which a light emitting panel is suppressed from being twisted or curved, and degradation of image quality can be prevented; and an image forming apparatus including the optical writing device.

In one or more embodiments of the present invention, an optical writing device in accordance with one or more embodiments of the present invention comprises: a long light emitting member on which a plurality of light emitting elements is arranged in a row; and a long holding member on which a plurality of projections is arranged at intervals, wherein the light emitting member is arranged in a state where a rear surface opposite to a light emitting surface of the light emitting member contacts tops of the respective projections, and the light emitting member is fixed to the holding member by applying adhesives to both sides in a short direction of each projection on the holding member in a manner separate from the projection.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, embodiments of the present invention will be described with reference to the drawings. However, the scope of the invention is not limited to the disclosed embodiments.

Hereinafter, an image forming apparatus 10 in accordance with one or more embodiments of the present invention will be described with reference to the drawings.

1.1 Structure of Image Forming Apparatus 10

Figure 1:
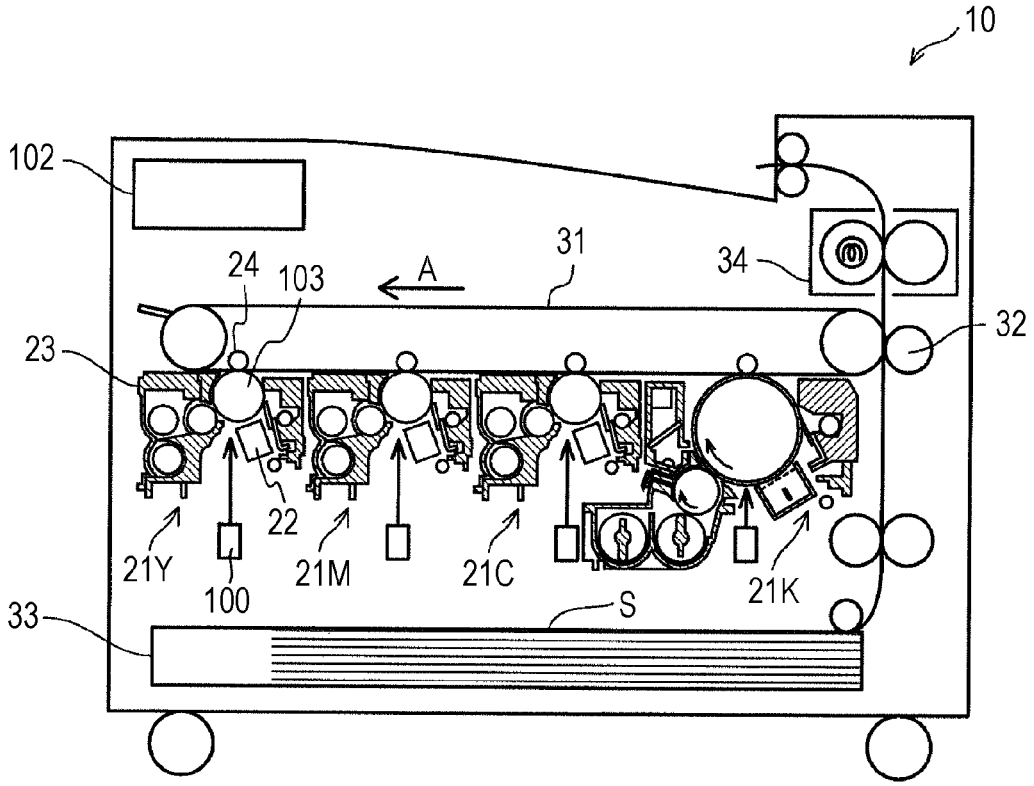
FIG. 1 is a diagram illustrating main components of an image forming apparatus in accordance with one or more embodiments.

FIG. 1 is a diagram illustrating main components of the image forming apparatus 10.

As illustrated in FIG. 1, the image forming apparatus 10 is a so-called tandem type color printer apparatus. Image formers 21Y, 21M, 21C and 21K included in the image forming apparatus 10 form toner images of respective colors of yellow (Y), magenta (M), cyan (C), and black (K) under the control of a controller 102.

For example, in the image former 21Y, a charging device 22 uniformly charges a peripheral surface of a photoreceptor drum 103. As described later, an optical writing device 100 includes light emitting elements arrayed in a line in a main scanning direction, and makes each of the light emitting elements emit light in accordance with a digital luminance signal generated by the controller 102. Consequently, optical writing is performed on the peripheral surface of the photoreceptor drum 103, and an electrostatic latent image is formed.

A developing device 23 develops (visualizes) the electrostatic latent image by supplying toner onto the peripheral surface of the photoreceptor drum 103. A primary transfer roller 24 electrostatically transfers a toner image from the photoreceptor drum 103 to an intermediate transfer belt 31 (primary transfer).

Similarly, toner images of the respective colors of M, C, and K formed by the image formers 21M, 21C, and 21K are primarily transferred onto the intermediate transfer belt 31 such that toner images overlap with one another. The color toner image formed by the primary transfer is conveyed to a secondary transfer roller 32 by the intermediate transfer belt 31 that circulates in a direction of an arrow A. Along with this conveyance, a recording sheet S supplied from a sheet feeding cassette 33 is also conveyed to the secondary transfer roller 32.

The secondary transfer roller 32 electrostatically transfers the toner image formed on the intermediate transfer belt 31 onto the recording sheet S (secondary transfer). The toner image is thermally fixed by a fixing device 34 on the sheet S where the toner image has been transferred, and then the sheet S is ejected to the outside of the machine.

1.2 Structure of Optical Writing Device 100

Figure 2A:
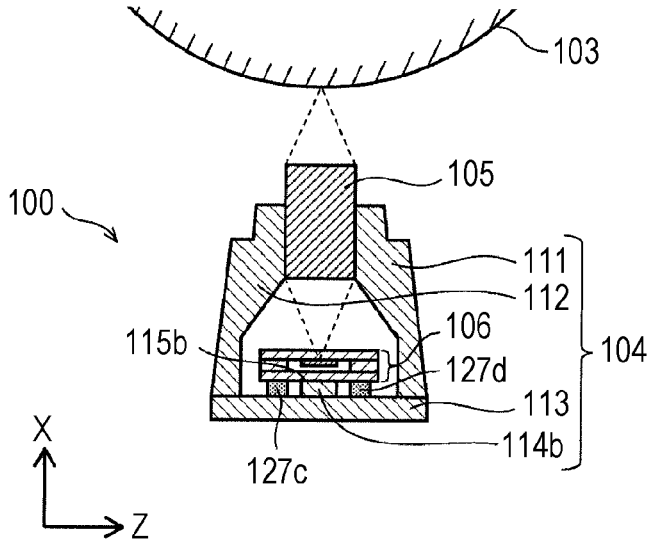
FIG. 2A illustrates a schematic structure of an optical writing device in accordance with one or more embodiments.
Figure 2B:
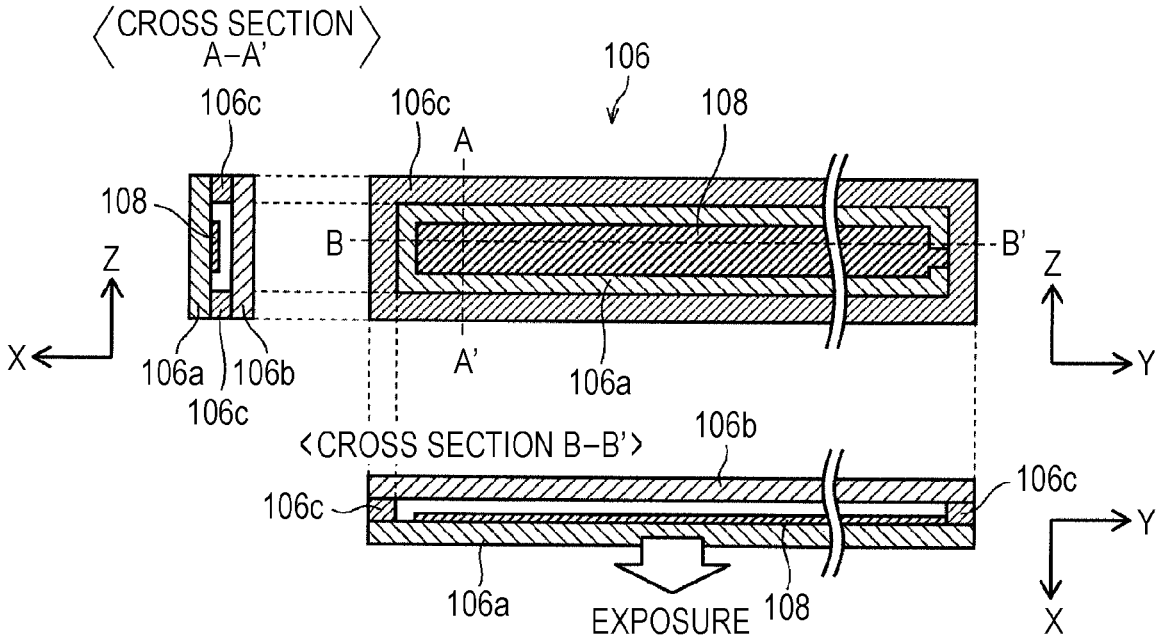
FIG. 2B illustrates a schematic plan view of a light emitting panel, a cross-sectional view taken along a line A-A' of the light emitting panel, and a cross-sectional view taken along a line B-B' of the light emitting panel in accordance with one or more embodiments.

FIGS. 2A and 2B illustrate a schematic structure of the optical writing device 100.

As illustrated in FIG. 2A, the optical writing device 100 includes a holder 104, a light emitting panel (light emitting member) 106, and a rod lens array 105.

(1) Light Emitting Panel 106

FIG. 2B illustrates a schematic plan view of the light emitting panel 106, a cross-sectional view taken along a line A-A' of the light emitting panel 106, and a cross-sectional view taken along a line B-B' of the light emitting panel 106. Note that the schematic plan view of FIG. 2B illustrates a state in which a sealing plate is removed.

The light emitting panel 106 has a plurality of light emitting elements arrayed thereon in a row, and the light emitting panel 106 is long in an array direction thereof. As illustrated in FIG. 2B, the light emitting panel 106 has a long thin film transistor (TFT) substrate 108 arranged on a long glass substrate 106*a*.

On the TFT substrate 108, n light emitting elements constituting a light emitting element array are formed by being arrayed in a row along the main scanning direction (Y-axis direction) at equal intervals. Additionally, a driving unit is formed on the TFT substrate 108, and the driving units makes the light emitting elements emit light by supplying drive current to the respective light emitting elements. Here, n is 15000, for example.

Each of the light emitting elements is, for example, an OLED. The OLED is formed of four layers including a cathode, an organic layer, an anode and a transparent substrate. The anode is a transparent electrode such as indium tin oxide (ITO), and the cathode is an electrode made of aluminum or the like. When the organic layer is energized, the OLED emits light, and the light is extracted through the anode and the transparent glass substrate 106*a*.

Additionally, as illustrated in FIG. 2B, in the TFT substrate 108, a substrate surface on which the light emitting element array is arranged is a sealing region, and a sealing plate 106*b* is mounted interposing a spacer frame body 106*c*. With this structure, the sealing region is sealed in a state dry nitrogen or the like is enclosed inside thereof so as not to contact outside air. Note that a moisture absorbent may be enclosed together inside the sealed region for moisture absorption. Additionally, the sealing plate 106*b* may be, for example, sealing glass or a material other than glass.

(2) Rod Lens Array 105

In the rod lens array 105, a plurality of columnar rod lenses is arranged in two rows in a zigzag manner along the main scanning direction (Y axis direction).

As illustrated in FIG. 2A, a beam spot is formed on the peripheral surface of the photoreceptor drum 103 by condensing light beams that have been emitted from the respective light emitting elements of the light emitting element array and have passed through the rod lens array 105. Here, a principal ray direction of the light beams emitted from the respective light emitting element of the light emitting element array is an X axis direction.

(3) Holder 104

As illustrated in FIG. 2A, the holder 104 is formed of a long bottom portion (holding member) 113, a side portion 111, and a side portion 112 which respectively extend in the main scanning direction. The holder 104 has a cross-sectional shape substantially U-shaped. The rod lens array 105 is clamped between the side portion 111 and the side portion 112.

Figure 3A:
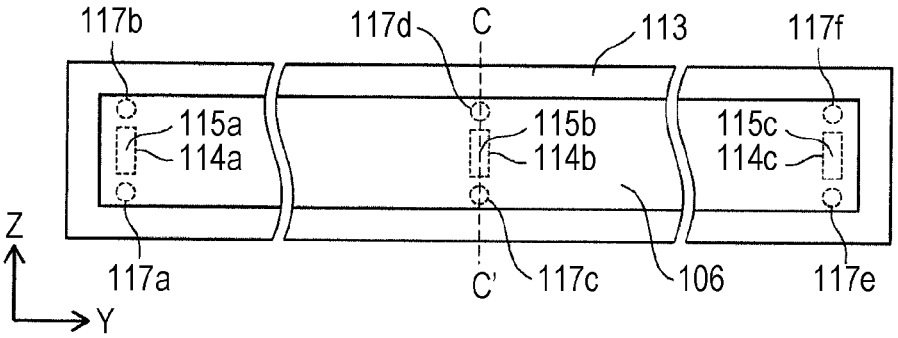
FIG. 3A illustrates a schematic plan view of the light emitting panel and a bottom portion in accordance with one or more embodiments.
Figure 3B:
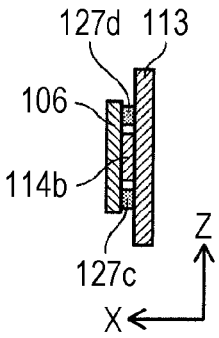
FIG. 3B is a cross-sectional view taken along a line C-C' line of the light emitting panel and the bottom portion shown in FIG. 3A.

FIG. 3A is a schematic plan view of the light emitting panel 106 illustrated in FIGS. 2A and 2B in the view from the rod lens 105 side, and FIG. 3B is a cross-sectional view taken along a line C-C' of FIG. 3A.

The bottom portion 113 is provided with three protrusions (projections or columnar bodies) 114*a*, 114*b* and 114*c* protruding from the bottom portion 113 toward the rod lens array 105 side (FIGS. 2A, 3A and 3B). Each of the protrusions 114*a*, 114*b*, and 114*c* has a rectangular parallelepiped shape formed long in a sub-scanning direction (Z-axis direction). The protrusion 114*b* is provided at a central portion in the main scanning direction, and the protrusions 114*a* and 114*c* are provided at both ends in the main scanning direction, respectively.

Among surfaces respectively forming the rectangular parallelepiped protrusions 114*a*, 114*b*, and 114*c*, top surfaces facing the rod lens array 105 constitute bearing surfaces 115*a*, 115*b*, and 115*c*. Each of the bearing surfaces 115*a*, 115*b*, and 115*c* has a width in the sub-scanning direction narrower than a width of the light emitting panel 106 in the sub-scanning direction. The bearing surfaces 115*a*, 115*b*, and 115*c* are arranged at regular intervals along a long direction (Y axis) on the bottom portion 113. The bearing surfaces 115*a*, 115*b*, and 115*c* define one flat surface, and the bearing surfaces 115*a*, 115*b*, and 115*c* hold the light emitting panel 106 while contacting a bottom surface of the sealing plate 106*b* of the light emitting panel 106 (rear surface on an opposite side of a light emitting surface of the light emitting panel 106) (FIGS. 2A, 3A and 3B). Since the respective bearing surfaces contact the bottom surface of the sealing plate 106*b* of the light emitting panel 106, the bottom portion 113 is separated from the light emitting panel 106 in a direction perpendicular to the bearing surfaces.

Adhesive application regions 117*c* and 117*d* are provided, in a manner separated from the protrusion 114*b*, at positions which are included in the bottom portion 113, correspond to the inside of a region where the light emitting panel 106 is arranged, and are located at center in the main scanning direction and on both sides in the sub-scanning direction of the protrusion 114*b*. Additionally, adhesive application regions 117*a* and 117*b* are provided, in a manner separated from the protrusion 114*a*, at positions which are included in the bottom portion 113, correspond to the inside of a region where the light emitting panel 106 is arranged, and are located on a first end side in the main scanning direction and on both sides in the sub-scanning direction of the protrusion 114*a*. Furthermore, adhesive application regions 117*e* and 117*f* are provided, in a manner separated from the protrusion 114*c*, at the positions which are included in the bottom portion 113, correspond to the inside of a region where the light emitting panel 106 is arranged, and are located on a second end side opposite to the first end in the main scanning direction and on both sides in the sub-scanning direction of the protrusion 114*c*.

The adhesive application regions 117*a*, 117*b*, 117*c*, 117*d*, 117*e* and 117*f* are each applied with an adhesive having a property of shrinking when the adhesive hardens. The adhesives having hardened after being applied to the adhesive application regions 117*a*, 117*b*, 117*c*, 117*d*, 117*e* and 117*f* will be denoted by reference signs 127*a*, 127*b*, 127*c*, 127*d*, 127*e* and 127*f*, respectively (FIGS. 3B, 4, and 5A. Some are not illustrated).

Thus, with the adhesives is applied to both sides in a short direction of the bottom portion 113 for each of the bearing surfaces in a manner separated from the bearing surfaces.

Figure 4:
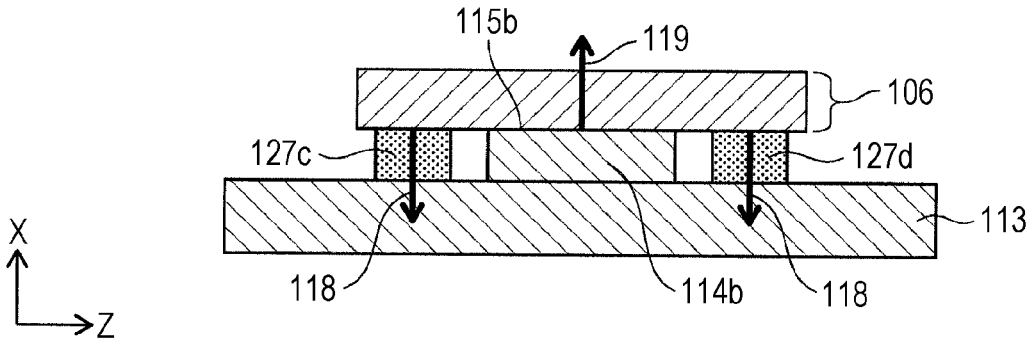
FIG. 4 illustrates a direction of reaction force on a bearing surface and a direction of hardening shrinkage force of an adhesive in accordance with one or more embodiments.
Figure 5A:
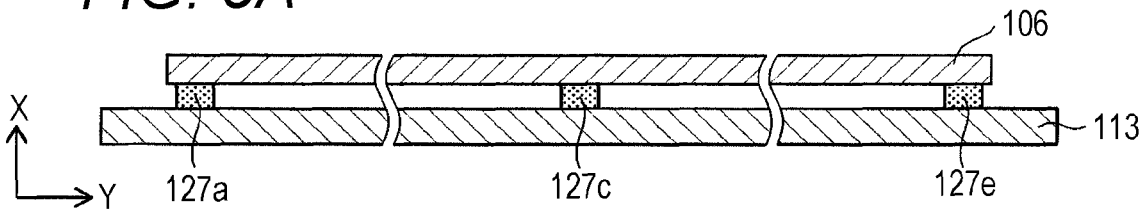
FIG. 5A illustrates a state before deformation of the light emitting panel and the bottom portion in accordance with one or more embodiments.
Figure 5A:
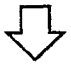

When the light emitting panel 106 is arranged in a manner contacting the bearing surfaces 115*a*, 115*b*, and 115*c* and then the applied adhesives harden, the light emitting panel 106 is fixed to the holder 104 with the adhesives 127*a*, 127*b*, 127*c*, 127*d*, 127*e*, and 127*f* having hardened (FIGS. 3B, 4, and 5A).

1.3 Conclusion

As described above, the optical writing device 100 according to one or more embodiments includes: the light emitting panel 106 having the plurality of light emitting elements arranged in the main scanning direction; and the holder 104 that holds the light emitting panel 106 by the bearing surfaces 115*a*, 115*b*, and 115*c* of the plurality of protrusions 114*a*, 114*b*, and 114*c* provided in the main scanning direction. The applied adhesive hardens so as to fill a gap between the bottom portion 113 of the holder 104 and the light emitting panel 106 separated in the principal ray direction by the protrusions 114*a*, 114*b* and 114*c*, and the light emitting panel 106 is fixed to the bottom portion 113 of the holder 104. The adhesives are applied to positions which are same in the main scanning direction in each of the bearing surfaces 115*a*, 115*b*, and 115*c* and are located on both sides in the sub-scanning direction in each of the bearing surfaces 115*a*, 115*b*, and 115*c*. Note that the respective adhesives do not contact the bearing surfaces 115*a*, 115*b*, and 115*c*.

Here, when the adhesive applied to an adhesive application region is thickly applied, an amount of shrinkage when the adhesive hardens is relatively increased. For this reason, there is concern that the light emitting panel 106 is curved due to hardening shrinkage of the adhesive. However, as illustrated in FIG. 3A, the adhesives are applied at the same positions as the bearing surfaces in the main scanning direction that is a long direction of the light emitting panel 106. With this structure, as illustrated in FIG. 4, hardening shrinkage force 118 of the adhesive can be canceled by reaction force 119 of the bearing surface. Therefore, the light emitting panel 106 can be suppressed from being curved in the main scanning direction.

At this point, the position of the bearing surface and that of the adhesive are deviated in the sub-scanning direction that is a short direction of the light emitting panel 106, but since the width of the light emitting panel in the sub-scanning direction is sufficiently short, a curved level of the light emitting panel 106 in the sub-scanning direction does not matter. Additionally, the TFT substrate 108 is suppressed from being curved in the main scanning direction by the curve of the light emitting panel 106 in the sub-scanning direction.

Furthermore, since the adhesives are applied to both sides in the sub-scanning direction of the bearing surface, two rotational moments centering the bearing surface and caused by the hardening shrinkage force of the adhesives applied to both sides are canceled, and the light emitting panel 106 can be suppressed from being twisted around the Y axis.

Figure 5B:
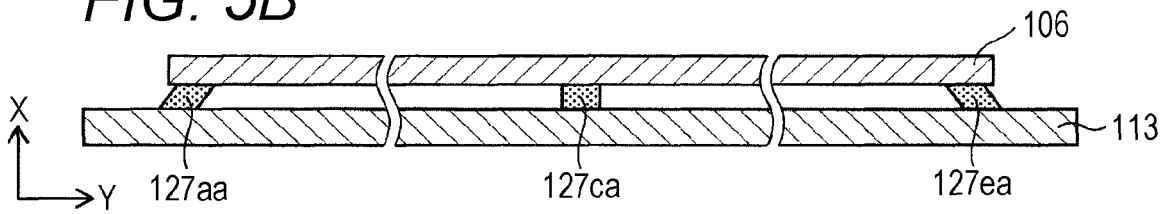
FIG. 5B illustrates a state after deformation of the light emitting panel and the bottom portion in accordance with one or more embodiments.

Additionally, as illustrated in FIGS. 3A and 3B, the adhesives are applied so as to fill the gap between the bottom portion 113 of the holder 104 and the light emitting panel 106 separated from each other, and also the adhesive is not made to contact the protrusions (and the bearing surface). With this structure, as illustrated in FIG. 5B, even in a case where a difference in thermal expansion is generated by a difference in a linear expansion coefficient between the light emitting panel 106 and the bottom portion 113 of the holder 104 due to a change in an environment temperature, adhesives 127*aa* and 127*ea* are distorted by absorbing the difference in thermal expansion, and therefore, thermal expansion occurring at the light emitting panel 106 (or holder 104) can be suppressed from influencing the other holder 104 (or light emitting panel 106). Here, FIG. 5A is a comparison target with FIG. 5B and illustrates a case where there is no change in the environment temperature after the adhesive has hardened.

Additionally, as described in the above "Summary", in the case of adopting a structure in which a light emitting panel is held by three bearing surfaces and the light emitting panel is bonded and fixed on an inner side of the three bearing surfaces, there may be following conditions.

Figure 15A:
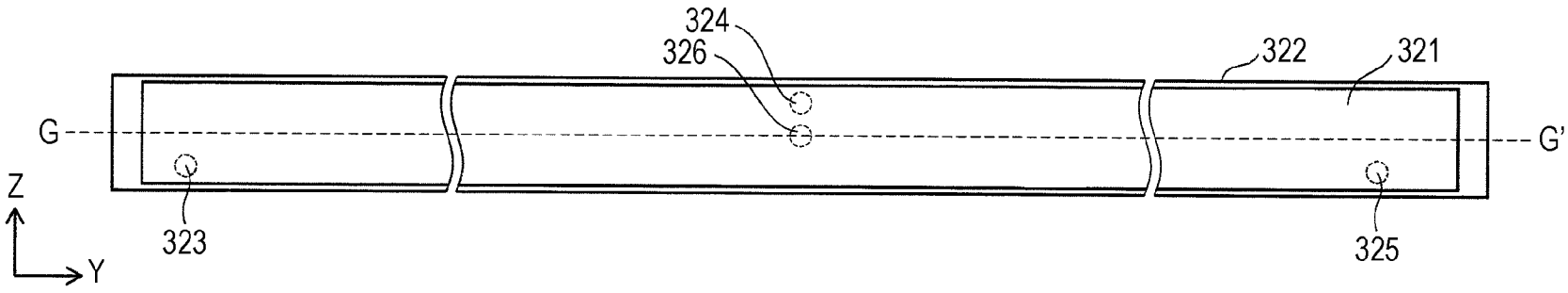
FIG. 15A illustrates a schematic plan view of a light emitting panel and a holder.
Figure 15B:
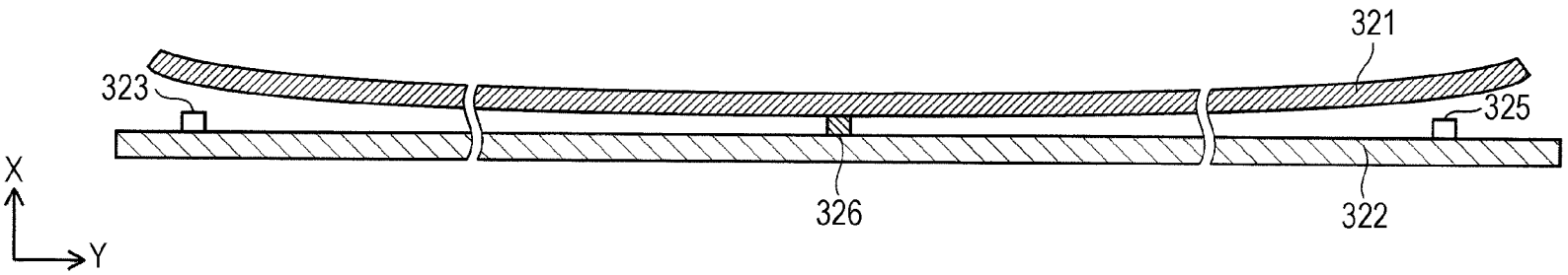
FIG. 15B is a cross-sectional view taken along a line G-G' of the light emitting panel and the holder.

For example, as illustrated in FIG. 15A, a light emitting panel 321 is arranged in a manner contacting three bearing surfaces 323, 324, and 325 provided in a holder 322, an adhesive is applied to an adhesive application region 326 provided on an inner side of a holding region defined by the bearing surfaces 323, 324, and 325, and when the applied adhesive hardens, the light emitting panel 321 is fixed to the holder 322. In this case, when processing accuracy of the light emitting panel 321 is insufficient and the light emitting panel is warped, warpage remains at both ends in a main scanning direction of the light emitting panel 321 due to hardening shrinkage of the adhesive as illustrated in FIG. 15B. Therefore, an optical distance from the light emitting panel to the photoreceptor is varied by a position in the main scanning direction of the light emitting panel. As a result, degradation of image quality may be caused.

In one or more embodiments, the degradation of image quality may be avoided by arranging the bearing surfaces at both ends in the main scanning direction of the bottom portion 113 respectively, and applying the adhesive close to the bearing surfaces.

1.4 Modified Example (1)

In one or more embodiments, the bottom portion of the light emitting panel 106 (rear surface on the opposite side of the light emitting surface of the light emitting panel 106) and the bottom portion 113 of the holder 104 are fixed with the adhesive. However, the method is not limited thereto. The following method may also be applicable.

Figure 6A:
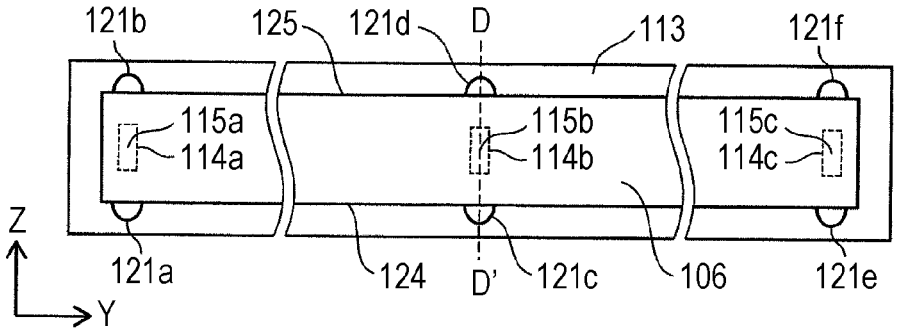
FIG. 6A illustrates the light emitting panel and the bottom portion bonded by potting as a modified example.
Figure 6B:
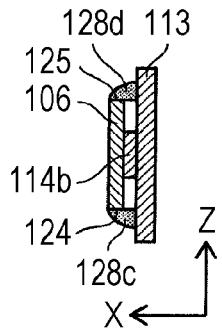
FIG. 6B is a cross-sectional view taken along a line D-D' of the light emitting panel and the bottom portion shown in FIG. 6A.

As illustrated in FIGS. 6A and 6B, adhesive application regions 121*c* and 121*d* are provided at positions which are included in the bottom portion 113, contact a region corresponding to where the light emitting panel 106 is arranged, and are located outside the region and at the center in the main scanning direction. The adhesive application regions 121*c* and 121*d* are arranged on both sides in the sub-scanning direction of the protrusion 114*b* in a manner separated from the protrusion 114*b*.

Additionally, adhesive application regions 121*a* and 121*b* are provided at positions which are included in the bottom portion 113, contact the region corresponding to where the light emitting panel 106 is arranged, and are located outside the region and at a first side in the main scanning direction. The adhesive application regions 121*a* and 121*b* are arranged on both sides in the sub-scanning direction of the protrusion 114*a* in a manner separated from the protrusion 114*a*.

Furthermore, adhesive application regions 121*e* and 121*f* are provided at positions which are included in the bottom portion 113, contact the region corresponding to where the light emitting panel 106 is arranged, and are located outside the region and at a second end side opposite to the first end in the main scanning direction. The adhesive application regions 121*e* and 121*f* are arranged on both sides in the sub-scanning direction of the protrusion 114*c* in a manner separated from the protrusion 114*c*.

Adhesives are applied to the adhesive application regions 121*a*, 121*c*, and 121*e* respectively by a potting, namely, filling method in a manner contacting a side surface 124 out of side surfaces 124 and 125 extending in the long direction of the light emitting panel 106. Additionally, the adhesives are applied to the adhesive application regions 121*b*, 121*d*, and 121*f* respectively by a potting, namely, filling method in a manner contacting the side surface 125 out of the side surfaces 124 and 125 extending in the long direction of the light emitting panel 106.

The adhesives that have been applied and hardened in the adhesive application regions 121*a*, 121*b*, 121*c*, 121*d*, 121*e* and 121*f* will be denoted by reference sings 128*a*, 128*b*, 128*c*, 128*d*, 128*e* and 128*f*, respectively (FIGS. 6A and 6B. Some are not illustrated).

When the light emitting panel 106 is arranged in a manner contacting the three bearing surfaces 115*a*, 115*b*, and 115*c* provided on the bottom portion 113 of the holder 104 and then the applied adhesives harden, the light emitting panel 106 is fixed to the holder 104 with the adhesives 128*a*, 128*b*, 128*c*, 128*d*, 128*e*, and 128*f* having hardened (FIGS. 6A and 6B).

Thus, the light emitting panel 106 can be fixed to the holder 104 by applying the adhesives by the potting method and making the adhesives harden.

1.5 Inappropriate Example

The following is an inappropriate example.

Figure 7:
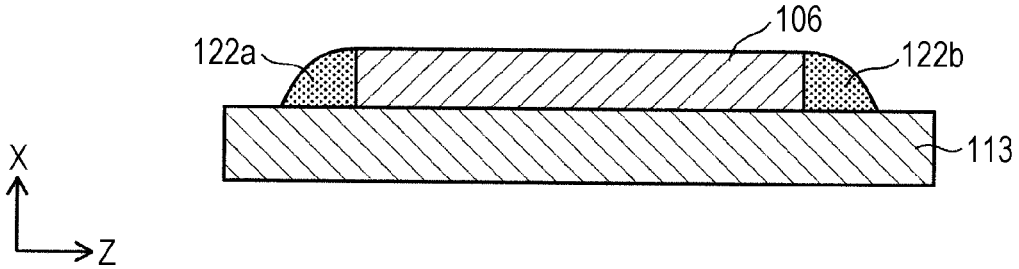
FIG. 7 illustrates a case where the light emitting panel and the bottom portion are not separated as an inappropriate example.

As illustrated in FIG. 7, the bottom portion 113 is not provided with a protrusion protruding from the bottom portion 113 toward the rod lens array 105 side, and holds the light emitting panel 106 on an upper surface of the bottom portion 113.

In this case, same as the case of the above modified example (1), six adhesive application regions are provided at positions which are included in the bottom portion 113, contact a region corresponding to where the light emitting panel 106 is arranged, and are located outside the region. In each of the adhesive application regions, the adhesive is applied by the potting, namely, filling method in a manner contacting the two side surfaces extending in the long direction of the light emitting panel 106. The adhesives that have been applied and have hardened in the respective adhesive application regions will be denoted by reference signs 122*a*, 122*b*, 122*c*, 122*d*, 122*e* and 122*f*, respectively (FIG. 7. Some are not illustrated).

When the light emitting panel 106 is arranged in a manner contacting the upper surface of the bottom portion 113 of the holder 104 and the applied adhesives harden, the light emitting panel 106 is fixed to the holder 104 with the adhesives 122*a*, 122*b*, 122*c*, 122*d*, 122*e*, and 122*f* having hardened.

In this case, to accurately hold the light emitting panel 106, it is necessary to process, into a flat surface having high accuracy, an entire portion contacting the light emitting panel 106 out of the bottom portion 113 of the holder 104, manufacturing cost may be increased. Additionally, in the event of a change in the environment temperature, a difference in thermal expansion between the light emitting panel 106 and the holder 104 may be hardly absorbed by the adhesives 122*a*, 122*b*, 122*c*, 122*d*, 122*e*, and 122*f*.

1.6 Modified Example (2)

In one or more embodiments, the plurality of bearing surfaces is arranged in the main scanning direction on the bottom portion 113 of the holder 104, and the bearing surfaces have widths in the main scanning direction and the sub-scanning direction. However, the structure is not limited to thereto. The following method may also be applicable.

Figure 8A:
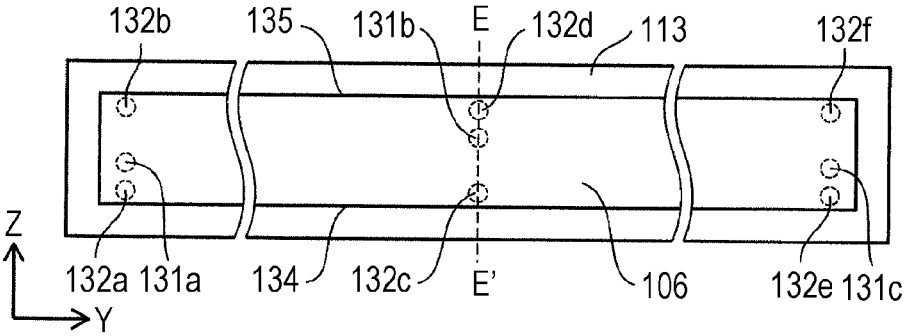
FIG. 8A illustrates a schematic plan view of the light emitting panel and the bottom portion as a modified example.
Figure 8B:
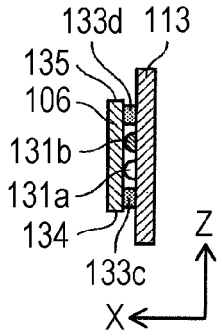
FIG. 8B is a cross-sectional view taken along a line E-E' of the light emitting panel and the bottom portion shown in FIG. 8A.

As illustrated in FIGS. 8A and 8B, three hemispherical protrusions (projections or protruding bodies) 131*a*, 131*b*, and 131*c* protruding from the bottom portion 113 toward the rod lens array 105 side are provided in a zigzag manner in the main scanning direction.

In other words, the protrusion 131*b* is provided at the center in the main scanning direction and close to a side surface 135 side out of side surfaces 134 and 135 extending in the main scanning direction. Additionally, the protrusion 131*a* is provided on the first end side in the main scanning direction and close to the side surface 134 side. Furthermore, the protrusion 131*c* is provided on the second end side opposite to the first end side in the main scanning direction and close to the side surface 134 side.

Tops of the hemispherical protrusions 131*a*, 131*b*, and 131*c* contact a bottom surface (rear surface) of the sealing plate 106*b* of the light emitting panel 106 to hold the light emitting panel 106.

Adhesive application regions 132*c* and 132*d* are provided at positions which are included in the bottom portion 113, correspond to the inside of the region where the light emitting panel 106 is arranged, and are located at the center in the main scanning direction. The adhesive application regions 132*c* and 132*d* are arranged in a manner separated from the protrusion 131*b* on both sides in the sub-scanning direction of the protrusion 131*b*, respectively.

Adhesive application regions 132*a* and 132*b* are provided at positions which are included in the bottom portion 113, correspond to the inside of the region where the light emitting panel 106 is arranged, and are located on the first end side in the main scanning direction. The adhesive application regions 132*a* and 132*b* are arranged on both sides in the sub-scanning direction of the protrusion 131*a*, respectively.

Furthermore, adhesive application regions 132*e* and 132*f* are provided at positions which are included in the bottom portion 113, correspond to the inside of the region where the light emitting panel 106 is arranged, and are located on a second end side opposite to the first end in the main scanning direction. The adhesive application regions 132*e* and 132*f* are arranged on both sides in the sub-scanning direction of the protrusion 131*c*.

Adhesives are applied to the adhesive application regions 132*a*, 132*b*, 132*c*, 132*d*, 132*e* and 132*f*. The adhesives that have been applied and hardened in the adhesive application regions 132*a*, 132*b*, 132*c*, 132*d*, 132*e* and 132*f* will be denoted by reference signs 133*a*, 133*b*, 133*c*, 133*d*, 133*e* and 133*f*, respectively (FIGS. 8A and 8B. Some are not illustrated).

When the light emitting panel 106 is arranged in a manner contacting the tops of the three hemispherical protrusions 131*a*, 131*b*, and 131*c* provided on the bottom portion 113 of the holder 104 and then the applied adhesives harden, the light emitting panel 106 is fixed to the holder 104 with the adhesives 133*a*, 133*b*, 133*c*, 133*d*, 133*e*, and 133*f* having hardened.

Meanwhile, the protrusions in this modified example have the hemispherical shapes, but the shape is not limited thereto. The shape may be a conical shape, a triangular pyramidal shape, or the like. Thus, the protrusion may be any shape as far as having a protruding body.

Thus, the light emitting panel 106 can be fixed to the holder 104.

Hereinafter, an image forming apparatus according to one or more embodiments of the present invention will be described with reference to the drawings.

The image forming apparatus of one or more embodiments differs from an image forming apparatus 10 of one or more embodiments described above in an optical writing device. Here, the optical writing device of the image forming apparatus of one or more embodiments will be described focusing on points different from the optical writing device 100 of one or more embodiments described above.

Figure 9:
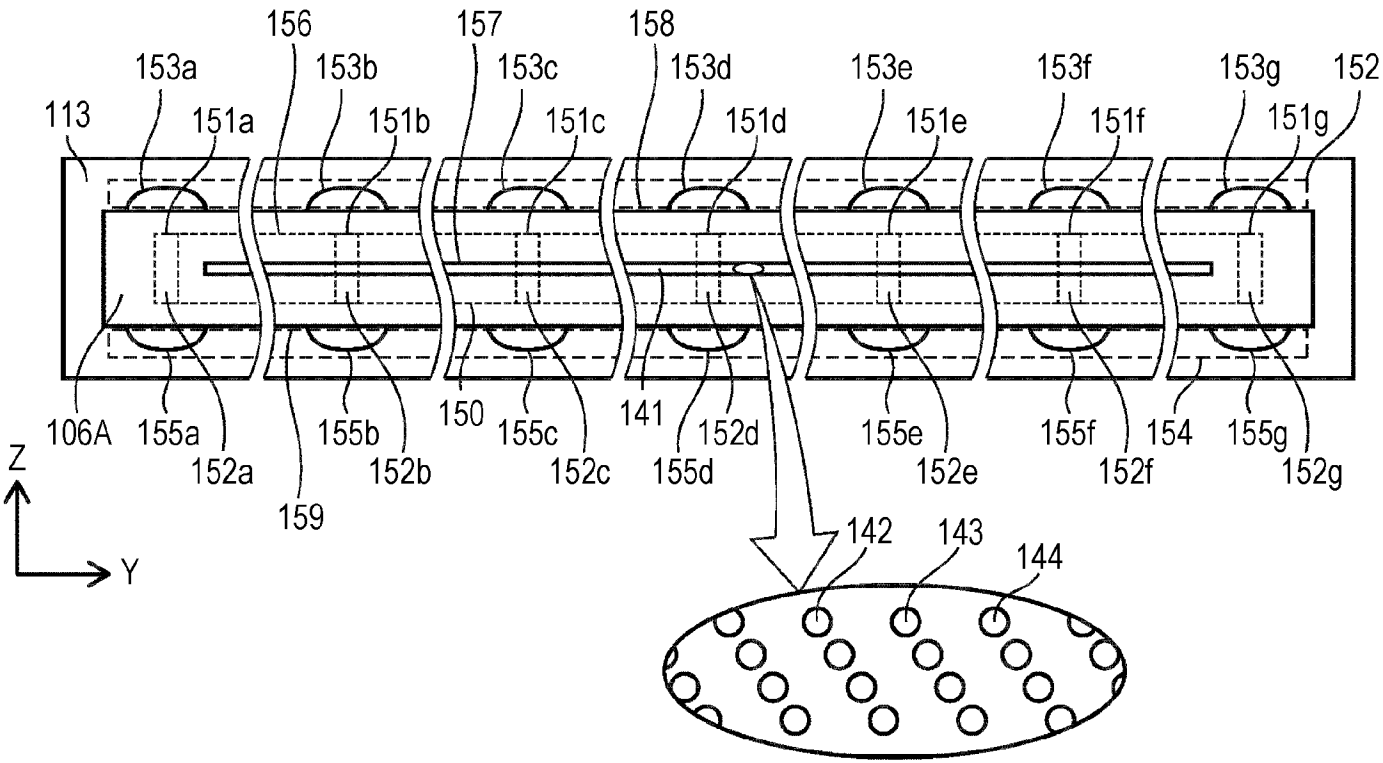
FIG. 9 illustrates a schematic plan view of a light emitting panel and a bottom portion in accordance with one or more embodiments.

As illustrated in FIG. 9, a plurality of light emitting elements 142, 143, 144, . . . constituting a light emitting element array is arranged in a light emitting element region 157 along a main scanning direction (Y axis direction), for example, in four rows at equal intervals in a zigzag manner on a light emitting panel 106A of the optical writing device.

Additionally, seven protrusions (columnar bodies) 151*a*, 151*b*, . . . , and 151*g* protruding from a bottom portion 113 of a holder 104 toward a rod lens array 105 side and each having a rectangular parallelepiped shape formed long in a sub-scanning direction (Z axis direction) are provided at predetermined intervals.

Bearing surfaces 152*a*, 152*b*, . . . , and 152*g* of the rectangular parallelepiped protrusions 151*a*, 151*b*, . . . , and 151*g* each facing the rod lens array 105 hold the light emitting panel 106A in a manner contacting a bottom surface (rear surface) of a sealing plate 106*b* of the light emitting panel 106A. Here, each of the bearing surfaces is a planar top surface (top) of each of the protrusions (columnar bodies) provided on the bottom portion 113. Each of the bearing surfaces 152*a*, 152*b*, . . . , and 152*g* has a width in the sub-scanning direction narrower than a width in the sub-scanning direction of the light emitting panel 106A.

The bottom portion 113 is provided with adhesive application regions 153*a* and 155*a* at positions which are included in the bottom portion 113, contact a region corresponding to where the light emitting panel 106A is arranged, and are located outside the region. The adhesive application regions 153*a* and 155*a* are arranged in a manner separated from the protrusion 151*a* on both sides in the sub-scanning direction of the protrusion 151*a*.

Additionally, the bottom portion 113 is provided with adhesive application regions 153*b* and 155*b* at positions which are included in the bottom portion 113, contact the region corresponding to where the light emitting panel 106A is arranged, and are located outside the region. The adhesive application regions 153*b* and 155*b* are arranged in a manner separated from the protrusion 151*b* on both sides in the sub-scanning direction of the protrusion 151*b*.

Similarly, in the following, adhesive application regions 153*c* and 155*c*, adhesive application regions 153*d* and 155*d*, . . . , and adhesive application regions 153*g* and 155*g* are provided in a manner corresponding to the protrusions 151*c*, 151*d*, . . . , 151*g*.

Adhesives are applied to the adhesive application regions 153*a*, 153*b*, . . . , and 153*g* respectively by a potting, namely, filling method in a manner contacting a side surface 158 extending in a long direction of the light emitting panel 106A. Additionally, the adhesives are applied to the adhesive application regions 155*a*, 155*b*, . . . , and 155*g* respectively by the potting, namely, filling method in a manner contacting a side surface 159 extending in the long direction of the light emitting panel 106A. Thus, the adhesives are applied to positions which are located on both sides in the sub-scanning direction of each of the bearing surfaces in a manner more distant from the light emitting element region 157 where the light emitting elements are arranged than the bearing surfaces are.

When the light emitting panel 106A is arranged in a manner contacting the seven bearing surfaces 152*a*, 152*b*, . . . , and 152*g* provided on the bottom portion 113 of the holder 104 and the adhesives that have been applied to the adhesive application regions 153*a* and 155*a*, 153*b* and 155*b*, . . . , 153*g* and 155*g* harden, the light emitting panel 106A is fixed to the holder 104 with the respective adhesives having hardened.

As described above, the plurality of light emitting elements is arranged on the light emitting panel 106A in a zigzag manner in the main scanning direction. In other words, the plurality of light emitting elements is arranged while having a width also in the sub-scanning direction. Additionally, the width of each of the bearing surfaces in the sub-scanning direction is wider than a width in the sub-scanning direction of the light emitting element region 157 where the light emitting elements are arranged.

A holding region 156 that is one imaginary flat surface is defined by an envelope that envelopes the seven bearing surfaces 152*a*, 152*b*, . . . , and 152*g*. The holding region 156 includes the light emitting element region 157 in the view from a light emitting direction (principal ray direction).

Thus, since the light emitting panel 106A is fixed to the holder 104 such that the holding region 156 envelopes the light emitting element region 157 in the view from the light emitting direction, a curve in the sub-scanning direction of the light emitting panel 106A caused by hardening shrinkage of the adhesives is hardly transmitted to the light emitting element region 157 that is required to have accuracy, and therefore, the light emitting panel can be held with accuracy higher than that in one or more embodiments described above.

Meanwhile, in one or more embodiments, the seven bearing surfaces are arranged in the sub-scanning direction, but the number of bearing surfaces in the sub-scanning direction is not limited thereto. The larger the number of bearing surfaces is, the higher accuracy the light emitting panel 106A can have. However, increasing the number of bearing surfaces leads to increase in a manufacturing cost for the holder, and therefore, it is preferable to appropriately select the number of bearing surfaces considering required accuracy and a target cost.

Hereinafter, an image forming apparatus according to one or more embodiments of the present invention will be described with reference to the drawings.

The image forming apparatus of one or more embodiments differs from an image forming apparatus 10 of one or more embodiments described above in an optical writing device. Here, the optical writing device of the image forming apparatus of one or more embodiments will be described focusing on points different from the optical writing device 100 of one or more embodiments described above.

Figure 10:
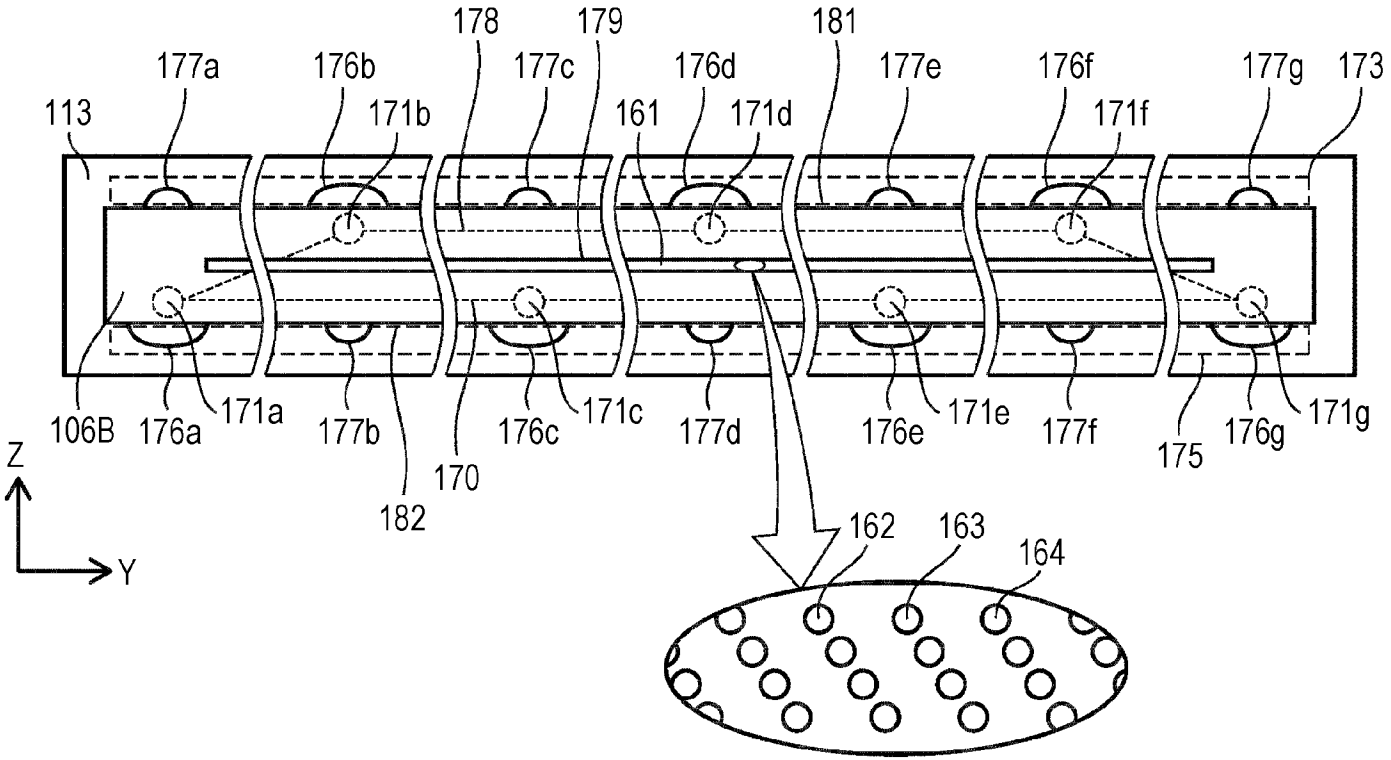
FIG. 10 illustrates a schematic plan view of a light emitting panel and a bottom portion in accordance with one or more embodiments.

As illustrated in FIG. 10, like a case of one or more embodiments described above, a plurality of light emitting elements 162, 163, 164, . . . constituting a light emitting element array is arranged in a light emitting element region 179 along a main scanning direction, for example, in four rows at equal intervals in a zigzag manner on a light emitting panel 106B of the optical writing device.

Additionally, seven hemispherical protrusions (projections, protruding bodies) 171*a*, 171*b*, . . . , and 171*g* protruding from a bottom portion 113 of a holder 104 toward a rod lens array 105 side are arranged in the main scanning direction at predetermined intervals in a zigzag manner. In other words, the protrusions 171*b*, 171*d*, and 171*f* are respectively provided close to a side surface 181 extending in the main scanning direction of the light emitting panel 106B, and the protrusions 171*a*, 171*c*, 171*e*, and 171*g* are respectively provided close to a side surface 182 extending in the main scanning direction of the light emitting panel 106B.

Tops of the hemispherical protrusions 171*a*, 171*b*, . . . , and 171*g* contact a bottom surface (rear surface) of a sealing plate 106*b* of the light emitting panel 106B, and hold the light emitting panel 106B.

Thus, the plurality of protrusions is arranged in a zigzag manner in a long direction of the bottom portion 113 on both sides in a short direction of a light emitting element region 161 having a plurality of light emitting elements arranged.

The bottom portion 113 is provided with adhesive application regions 176*a* and 177*a* at positions which are included in the bottom portion 113, contact a region corresponding to where the light emitting panel 106B is arranged, and are located outside the region. The adhesive application regions 176*a* and 177*a* are arranged in a manner separated from the protrusion 171*a* on both sides in the sub-scanning direction of the protrusion 171*a*. The area of the adhesive application region 176*a* located on a side close to the protrusion 171*a* is larger than the area of the adhesive application region 177*a*.

Additionally, the bottom portion 113 is provided with adhesive application regions 176*b* and 177*b* at positions which are included in the bottom portion 113, contact the region corresponding to where the light emitting panel 106B is arranged, and are located outside the region. The adhesive application regions 176*b* and 177*b* are arranged in a manner separated from the protrusion 171*b* on both sides in the sub-scanning direction of the protrusion 171*b*. The area of the adhesive application region 176*b* located on a side close to the protrusion 171*b* is larger than the area of the adhesive application region 177*b*.

Similarly, in the following, adhesive application regions 176*c* and 177*c*, adhesive application regions 176*d* and 177*d*, . . . , and adhesive application regions 176*g* and 177*g* are provided in a manner corresponding to the protrusions 171*c*, 171*d*, . . . , 171*g*. The area of the adhesive application region 176*c* located on a side close to the protrusion 171*c* is larger than the area of the adhesive application region 177*c*, and the area of the adhesive application region 176*d* located on a side close to the protrusion 171*d* is larger than the area of the adhesive application region 177*d*. The same is applied in the following.

Adhesives are applied to the adhesive application regions 176*a* and 177*a*, 176*b* and 177*b*, . . . , 176*g* and 177*g*, respectively, by a potting, namely, filling method in a manner contacting side surfaces 182 and 181 extending in a long direction of the light emitting panel 106B, and amounts of the adhesives are determined in accordance with the area of the respective adhesive application regions.

When the light emitting panel 106B is arranged in a manner contacting the tops of the seven hemispherical protrusions 171*a*, 171*b*, . . . , 171*g* provided on the bottom portion 113 of the holder 104 and the adhesives that have been applied to the adhesive application regions 176*a*, 177*a*, 176*b* and 177*b*, . . . , and 176*g* and 177*g* harden, the light emitting panel 106B is fixed to the holder 104 with the adhesives having hardened.

As described above, the plurality of light emitting elements is arranged on the light emitting panel 106B in a zigzag manner in the main scanning direction. In other words, the plurality of light emitting elements is arranged while having a width also in the sub-scanning direction.

A holding region 178 that is a flat surface is defined by a line connecting the tops of hemispheres of the seven protrusions 171*a*, 171*b*, . . . , 171*g*. The holding region 178 has a width in the sub-scanning direction wider than a width in a substantially entire region of the light emitting element region 179 where the light emitting elements are arranged. Therefore, the holding region 178 substantially includes the light emitting element region 179 in a principal ray direction. The width in the sub-scanning direction of the holding region 178 is narrower than the width in the sub-scanning direction of the light emitting panel 106B.

Thus, the seven protrusions 171*a*, 171*b*, . . . , and 171*g* are arranged in a zigzag manner so as to stride across the light emitting element region 179, and an application amount of the adhesive applied to a side close to a protrusion is less than an application amount of the adhesive applied to a side distant from a protrusion in the sub-scanning direction. In other words, among the application amounts of the adhesives applied to both sides of each of the protrusions in the short direction of the bottom portion 113, the application amount of the adhesive applied to a side close to a protrusion is larger than the application amount of the adhesive applied to a side distant from a protrusion.

(Conclusion)

In a case where highly-accurate processing is performed for flatness of all of the plurality of bearing surfaces provided in the sub-scanning direction, a cost is increased. However, by minimizing the area of each of the bearing surfaces, accuracy of the bearing surface can be improved while avoiding the cost increase. In one or more embodiments, the light emitting panel 106B is held by the tops of the protrusions by forming each of the protrusions in a hemispherical shape. Thus, since the plurality of protrusions is arranged in a zigzag manner in the main scanning direction, the holding region 178 that is one flat surface can be defined by the tops of the plurality of protrusions, and the light emitting panel 106B can be held by the holding region 178.

Furthermore, since the plurality of protrusions is arranged in a zigzag manner, a distance to a protrusion from a position applied with the adhesive is different in both sides in the sub-scanning direction, and therefore, it is preferable to suitably adjust the application amount of the adhesive so as to cancel rotational moments which are caused by hardening shrinkage force of the adhesives located in the respective positions on both sides in the sub-scanning direction interposing each protrusion, and each of the rotational moments is generated around an axis along the main scanning direction of the light emitting panel 106B while centering each protrusion.

According to the above-described structure, the adhesives are applied to both sides of each of the protrusions in the short direction of the bottom portion 113, and among the adhesives applied to both sides of each of the protrusions in the short direction of the bottom portion 113, force to attract the light emitting panel 106B to the bottom portion 113 side by hardening of the adhesive applied to the side close to a protrusion is larger than force to attract the light emitting panel 106B to the bottom portion 113 side by hardening of the adhesive applied to the side distant from a protrusion.

With this structure, the light emitting panel 106B is prevented from being twisted in the sub-scanning direction.

Also, the rotational moments can be canceled not only by adjusting the application amounts of the adhesives but also by controlling a hardening shrinkage rate and an elastic modulus by changing a kind of adhesive. In other words, among the adhesives applied to both sides of each of the protrusions in the short direction of the bottom portion 113, a hardening shrinkage rate of the adhesive or an elastic modulus after hardening of the adhesive applied to the side close to a protrusion may be larger than the hardening shrinkage rate of the adhesive or an elastic modulus after hardening of the adhesive applied to the side distant from a protrusion.

Hereinafter, an image forming apparatus according to one or more embodiments of the present invention will be described with reference to the drawings.

The image forming apparatus of one or more embodiments differs from an image forming apparatus 10 of one or more embodiments described above in an optical writing device. Here, the optical writing device of the image forming apparatus of one or more embodiments will be described focusing on points different from the optical writing device 100 of one or more embodiments described above.

Figure 11A:
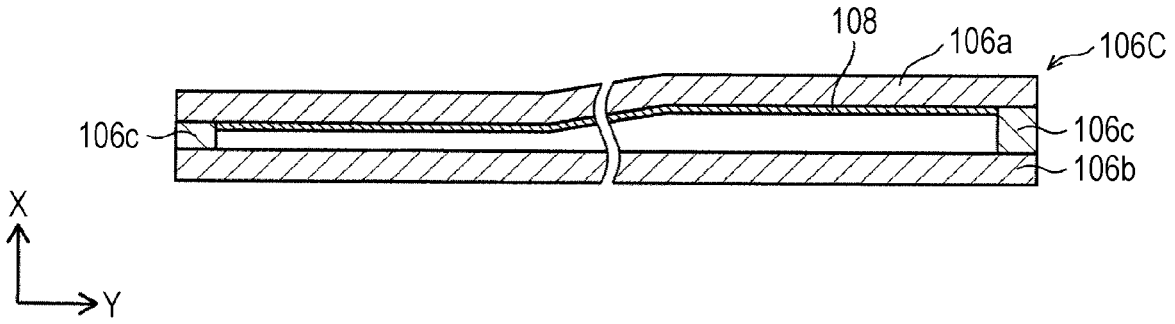
FIG. 11A illustrates a cross-sectional view of a light emitting panel in accordance with one or more embodiments.
Figure 11B:
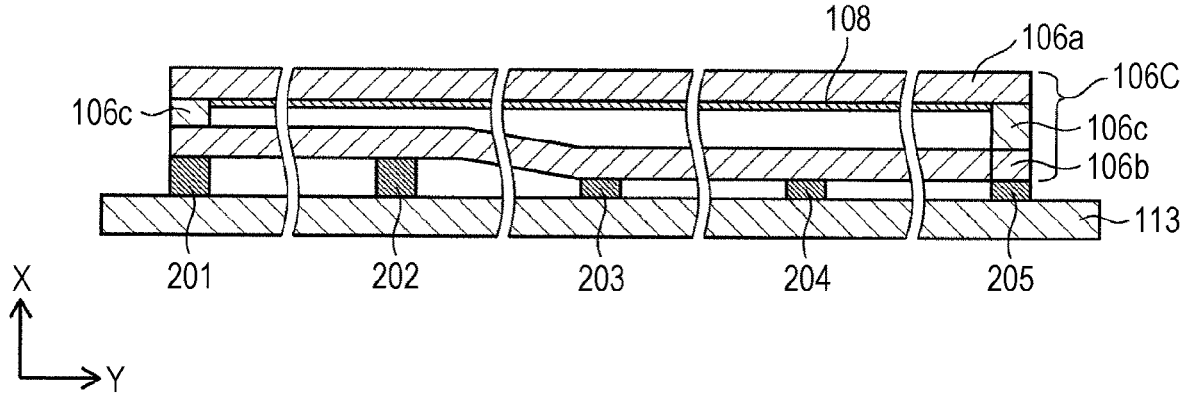
FIG. 11B is a cross-sectional view of the light emitting panel and the bottom portion in accordance with one or more embodiments.
Figure 12A:
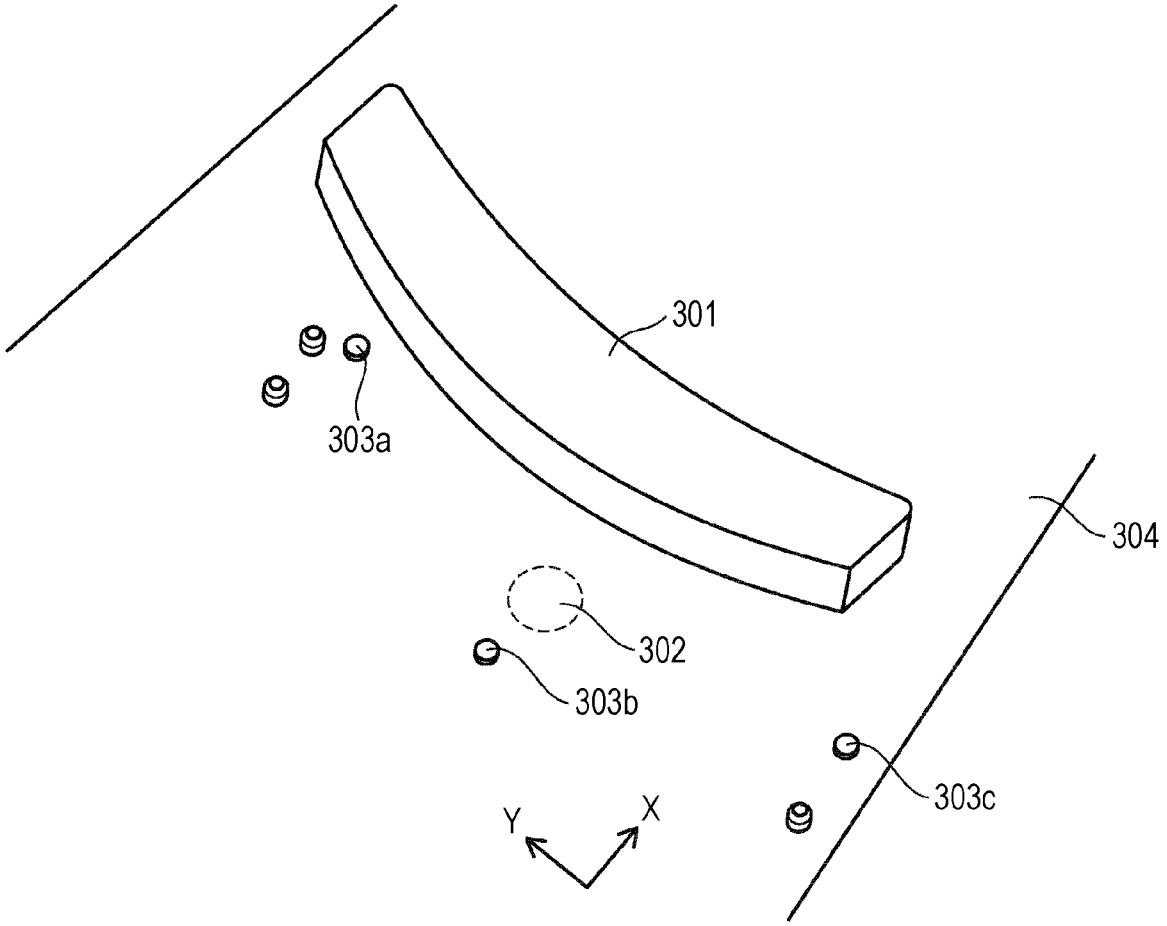
FIG. 12A is a perspective view illustrating a state before assembling an optical member and a holder in the related art.
Figure 12B:
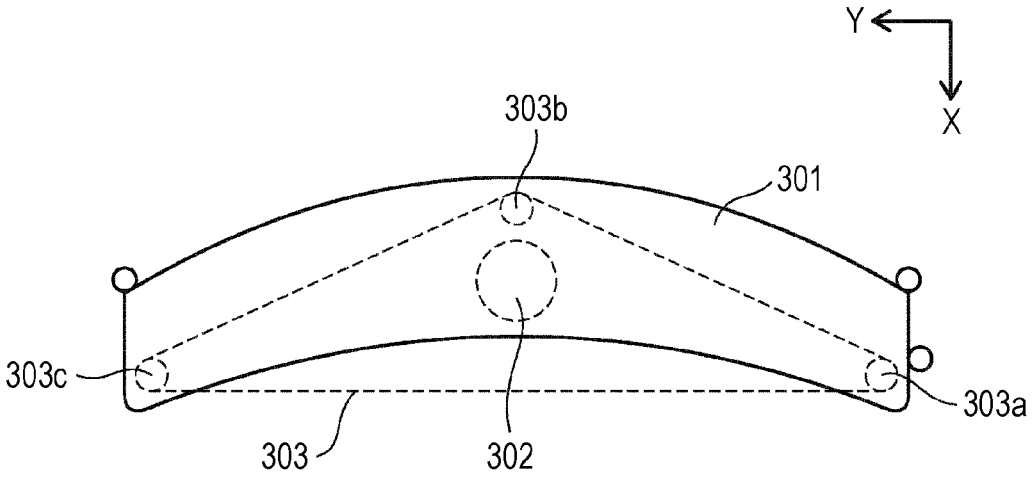
FIG. 12B is a schematic plan view illustrating a state after assembling the optical member and the holder in the related art.
Figure 13B:
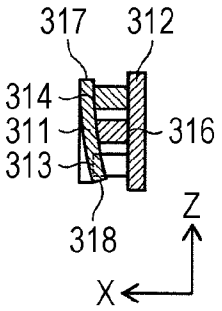
FIG. 13B is a cross-sectional view taken along a line F-F' of the light emitting panel and the holder.
Figure 13A:
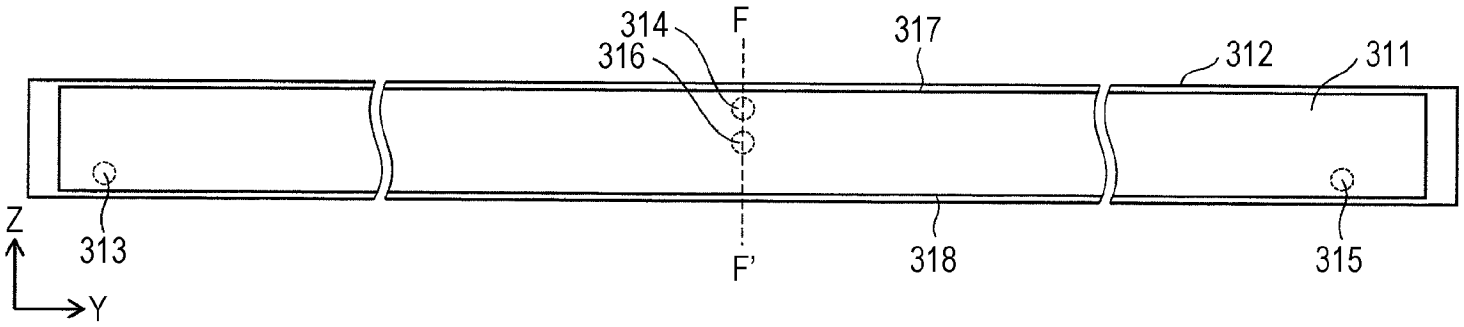
FIG. 13A illustrates a schematic plane view of a light emitting panel and a holder.
Figure 14A:
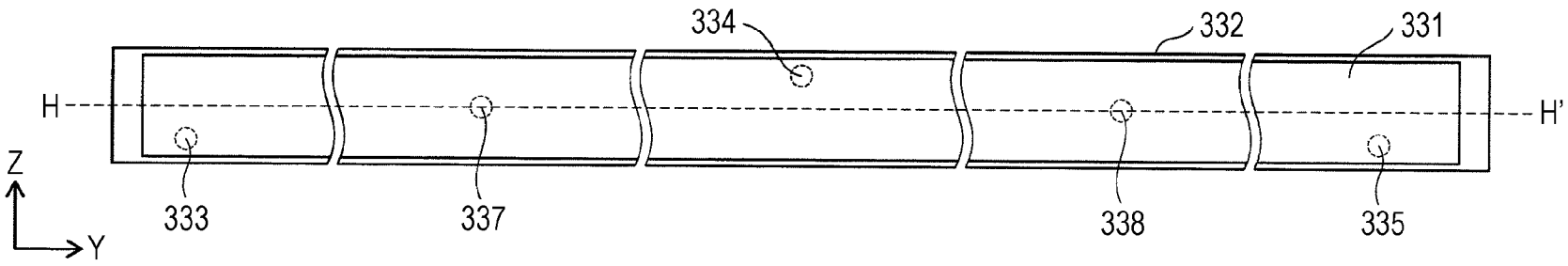
FIG. 14A illustrates a schematic plan view of a light emitting panel and a holder.
Figure 14B:
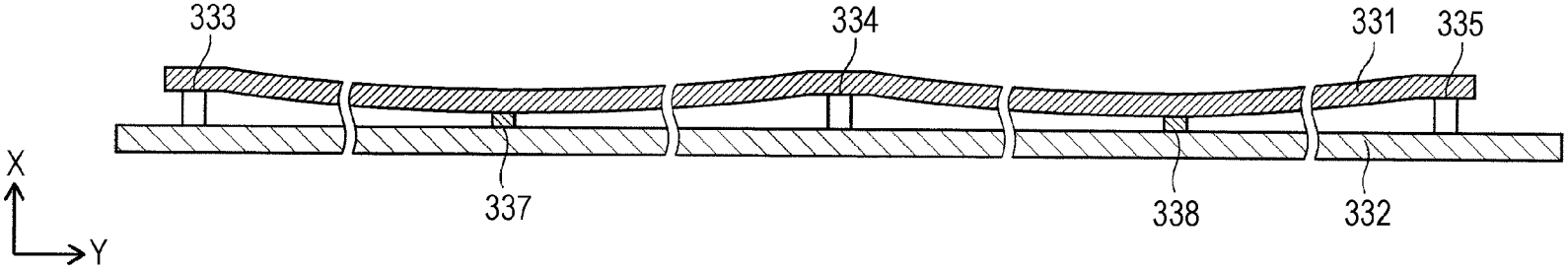
FIG. 14B is a cross-sectional view taken along a line H-H' of the light emitting panel and the holder.

As illustrated in FIG. 11A, a light emitting panel 106C has a structure same as a light emitting panel 106 of the optical writing device 100 of one or more embodiments described above. However, in the light emitting panel 106C, there may be an error in a thickness in a principal ray direction (direction of a light beam emitted from a light emitting element, namely, X axis direction). For example, a thickness of a first end in the principal ray direction of the light emitting panel 106C is different from a thickness of a second end opposite to the first end.

Thus, even when the light emitting panel 106C having an error in the thickness in the principal ray direction is made to contact bearing surfaces highly accurately processed to have the same height on a bottom portion 113 of a holder 104, the light emitting elements on the light emitting panel 106C may not be aligned on the same plane. Therefore, an optical distance to a photoreceptor from the light emitting panel is varied by a position in the main scanning direction of the light emitting panel 106C and image quality of an image may be degraded.

To avoid degradation of image quality, the bottom portion 113 of the holder 104 and a protrusion (columnar body) forming a bearing surface are formed as separate members.

A plurality of protrusions 201, 202, . . . , and 205 each having a height in accordance with a thickness at each position in the main scanning direction of the light emitting panel 106C is manufactured, and the manufactured protrusions 201, 202, . . . , and 205 are fixed at corresponding positions in the main scanning direction of the bottom portion 113 of the holder 104. Next, like the case of one or more embodiments described above, an adhesive is applied between the light emitting panel 106C and the bottom portion 113, and then the light emitting panel 106C is arranged in a manner contacting the bearing surfaces of each top surface of the protrusions 201, 202, . . . , and 205. When the applied adhesive hardens, the light emitting panel 106C is fixed to the bottom portion 113.

Thus, according to one or more embodiments, even in the case where the light emitting elements formed on the light emitting panel 106C are not aligned on the same plane due to existence of an error in a thickness in the principal ray direction of the light emitting panel 106C, the light emitting elements formed on the light emitting panel 106C can be arranged on the same plane with high accuracy by providing, on the bottom portion 113 of the holder 104, the bearing surfaces each having a height adjusted in the principal ray direction.

Here, each of the protrusions is a rectangular parallelepiped columnar body. However, the shape is not limited thereto. A protrusion may be a protruding body such as a hemispherical shape or a conical shape. Each bearing surface is a flat top surface of the columnar body or an apex of the protruding body.

As described above, the light emitting panel 106C has the plurality of light emitting elements arranged in a row, and the bottom portion 113 of the holder 104 has the plurality of protrusions (protrusion bodies) 201 to 205 arranged in a long direction. The bottom portion 113 is separated from the light emitting panel 106C in a direction perpendicular to the bearing surface in a state where the bearing surface of each protrusion contacts a rear surface opposite to a light emitting surface of the light emitting panel 106C. The adhesives are applied to both sides in the short direction of the bottom portion 113 between the light emitting panel 106C and the bottom portion 113 in a manner separated from the bearing surface. The light emitting panel 106C is fixed to the bottom portion 113 with the adhesives that have been applied and have hardened. The height of each protrusion in the light emitting direction is adjusted in accordance with the height in the light emitting direction of the light emitting panel 106C at the position where the bearing surface of each protrusion contacts the light emitting panel 106C. In other words, the height of each protrusion in the light emitting direction is adjusted in accordance with an optical distance to a photoreceptor drum 103 from a position where the top of the protrusion contacts the light emitting panel 106C.

5 Other Modified Examples (1) In one or more embodiments described above, the bearing surfaces of protrusions are arranged at the seven positions in the sub-scanning direction, adhesive application regions are provided on both sides in the sub-scanning direction of every bearing surface, and adhesives are applied to the adhesive application regions. However, the shape is not limited thereto.

In some adhesive application regions illustrated in FIG. 9, the adhesive may not be necessarily applied.

For example, the adhesive may not be necessarily applied to the adhesive application regions 153*d* and 155*d* arranged on both sides in the sub-scanning direction of the bearing surface 152*d*.

Additionally, the adhesive may not be necessarily applied to the adhesive application region 153*c* arranged on one side in the sub-scanning direction of the bearing surface 152*c* and the adhesive application region 155*e* arranged on one side in the sub-scanning direction of the bearing surface 152*e*.

Thus, the adhesive may also be applied only to one side in the sub-scanning direction for some protrusions out of the plurality of protrusions.

Additionally, in a case of defining a plurality of protrusions as first protrusions, a second protrusion may be formed on the bottom portion 113, the rear surface of the light emitting panel 106A may contact a top of the second protrusion, and adhesive may be applied to only one side in the short direction on the bottom portion 113 relative to the second protrusion.

Thus, the light emitting panel is stably fixed to the holder even when the adhesive is not applied to only the very few number of adhesive application regions out of many adhesive application regions. Additionally, a manufacturing cost can be reduced by omitting some of manufacturing processes.

(2) In one or more embodiments described above, the light emitting panel has a plurality of light emitting elements arranged in a zigzag manner along the main scanning direction. However, the shape is not limited thereto.

In the light emitting panel used for multiple exposure, a plurality of light emitting elements may be formed in a lattice shape along the main scanning direction.

(3) In one or more embodiments, the light emitting element is assumed to be an OLED, but not limited thereto.

The light emitting element may be a light emitting diode (LED).

(4) The above-described embodiments and the above-described modified examples may be combined.

The optical writing device according to one or more embodiments of the present invention provides excellent effects of suppressing a light emitting panel from being twisted or curved and preventing degradation of image quality, and is useful as an optical writing device including: the light emitting panel having a plurality of light emitting elements arranged; and a holder therefor.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

What is claimed is:

1. An optical writing device comprising:

a light emitting member on which a plurality of light emitting elements are arranged in a row; and a holding member on which a plurality of projections are arranged at intervals, wherein a rear surface of the light emitting member opposite to a light emitting surface of the light emitting member contacts tops of the projections, and the light emitting member is fixed to the holding member via adhesives disposed on two opposite sides of each of the projections in a short direction of the holding member so as to be separated from the projection.

2. The optical writing device according to claim 1, wherein when an envelope envelops the tops of the projections, a light emitting element region having the light emitting elements is arranged on an inner side of the envelope in a view from a light emitting direction, and for each of the projections, the adhesives are more separated from the light emitting element region than from the projection.

3. The optical writing device according to claim 1, wherein the projections are arranged in a zigzag manner along a long direction of the holding member, and each of the projections is separated from the light emitting element region in the short direction of the holding member.

4. The optical writing device according to claim 3, wherein a first adhesive among the adhesives is larger and closer to an adjacent projection among the projections than a second adhesive among the adhesives on the opposite side of the adjacent projection.

5. The optical writing device according to claim 3, wherein a first adhesive among the adhesives is closer to an adjacent projection among the projections than a second adhesive among the adhesives on the opposite side of the adjacent projection, and a hardening shrinkage rate of the first adhesive or an elastic modulus after hardening of the first adhesive is larger than a hardening shrinkage rate of the second adhesive or an elastic modulus after hardening of the second adhesive, respectively.

6. The optical writing device according to claim 1, wherein, the projections are defined as first projections, and the optical writing device includes a second projection disposed on the holding member such that a rear surface of the light emitting member contacts a top of the second projection, and an adhesive is applied only to one side of the holding member relative to the second projection in the short direction of the holding member.

7. The optical writing device according to claim 1, wherein the tops of the plurality of projections constitute one imaginary flat surface.

8. The optical writing device according to claim 1, wherein a height of each of the projections in a light emitting direction is adjusted in accordance with an optical distance from where the top of the projection contacts the light emitting member to a photoreceptor.

9. An image forming apparatus comprising the optical writing device according to claim 1.

* * * * *